US005126791A

United States Patent [19]

Kurihara

[11] Patent Number: 5,126,791

[45] Date of Patent: Jun. 30, 1992

[54] IMAGE FORMING APPARATUS WITH IMPROVED PATCH IMAGE FORMATION

[75] Inventor: Susumu Kurihara, Hachioji, Japan

[73] Assignee: Konica Corporation, Tokyo, Japan

[21] Appl. No.: 719,250

[22] Filed: Jun. 21, 1991

[30] Foreign Application Priority Data

Jul. 5, 1990 [JP] Japan ..... 2-176376

[51] Int. Cl.[5] ..... G03G 21/00

[52] U.S. Cl. ..... 355/208; 355/233; 355/243; 355/246

[58] Field of Search ..... 355/233, 234, 243, 236, 355/246, 208

[56] References Cited

U.S. PATENT DOCUMENTS 4,839,698 6/1989 Inuzuka et al. ..... 355/243

5,021,822 6/1991 Morikawa ..... 355/243 X

*Primary Examiner*—A. T. Grimley

*Assistant Examiner*—Shuk Y. Lee

*Attorney, Agent, or Firm*—Frishauf, Holtz, Goodman & Woodward

[57] ABSTRACT

An image forming apparatus in which when a brake sensor detects a holding frame of exposure light source which moves in the backward direction, the movement of exposure light source is braked and reversed in the forward direction so that a density reference plate and a document are exposed by the exposure light source and patch image obtained by the exposure of the density reference plate is utilized for controlling the toner density. The duration of braking time which is started by turn-on of the brake sensor is previously set in accordance with the magnification of reproduction. The duration of braking time is increased as the magnification of reproduction is set greater.

7 Claims, 3 Drawing Sheets

IMAGE FORMING APPARATUS WITH IMPROVED PATCH IMAGE FORMATION

BACKGROUND OF THE INVENTION

1. Field of the Invention

The present invention relates to an image forming apparatus wherein an image is formed by an electrostatic electrophotographic system, and more particularly relates to an image forming apparatus whose patch image forming portion for toner density control is improved.

2. Description of the Prior Art

FIG. 3 shows a schematic drawing of a reproducing apparatus. Reference numeral 1 denotes a case member. A document glass plate 2 and a cover 3 for covering the document glass plate 2 are fitted to the upper surface of the case member 1; A rod-like exposure light source 4 for effecting an exposure scan in a direction indicated by an arrow a, mirrors 6 to 9 for guiding light issued from the light source 4 and reflected from a document 36 placed on the document glass plate 2 to a photosensitive drum 5 and an image forming lens 10 are disposed on the lower surface of the document glass plate 2. Disposed around the photosensitive drum 5 are a charging electrode 11 for charging the photosensitive surface of the photosensitive drum 5 to a high voltage, a charge eliminating lamp 12 for eliminating unnecessary charges among the charges which are given by the charging electrode 11, a developing device 13 for developing a latent image formed by the exposure with toner, a transfer electrode 14 for transferring the resulting toner image to transfer paper, a separating electrode 15 for separating this transfer paper from the photosensitive drum 5, a photoelectric sensor 16 of a reflection type for detecting transfer paper which is wound on the photosensitive drum 5 and for detecting the density of a patch image, a cleaner 17 for removing the toner remaining on the photosensitive surface of the photosensitive drum 5, and so forth. Reference numeral 18 denotes a conveyor belt for conveying transfer paper after separation; 19 is a fixing unit for thermally fixing the toner image on transfer paper; 20 is a paper discharge tray; 21 to 23 are paper feed cassettes in which stacks of transfer paper having different sizes are loaded, respectively; 24 to 26 are feed rollers for feeding one sheet of transfer paper, respectively; 27 to 29 are first feed rollers for feeding transfer paper fed by the feed rollers 24 to 26 to guides 30 to 32, respectively; 33 are second feed rollers for establishing a timing between the edge of the fed transfer paper and the edge of an image formation region on the photosensitive drum 5; and 34 is a guide for sending transfer paper to the photosensitive drum 5. Reference numeral 35 denotes a density reference plate of black color for controlling the toner density; 36 denotes a document placed on the document glass plate 2; 37 denotes a brake sensor; and 38 denotes a holding frame for holding the light source 4 and the mirrors 6~8.

In this reproducing apparatus, after the document 36 is set onto the document glass plate 2, the document glass plate cover 3 is closed and then a copy button on the operation panel (not shown) is pressed down. Thus, the light source 4 moves at first in the backward direction (the return direction) opposite to that indicated by the arrow a and the size of the document 36 is detected. (A detailed explanation of the size detection is omitted because it has no direct relation to the present invention.) When the movement of the light source in the backward direction is continued, the holding frame 38 of the light source 4 is detected by the brake sensor 37, so that the holding frame 38 of the light source 4 receives a braking force and is decelerated, reversed at a reversing point P1 shown in FIG. 4 and then sent traveling in the forward direction indicated by the arrow a.

In the movement of the holding frame 38 in the forward direction, the light source 4 continues to illuminate the density reference plate 35 and to illuminate the document 36. Accordingly, a patch image (toner image) **5*b* is formed in a non-image forming region 5*a* of the photosensitive drum 5 as shown in FIG. 5 and a document image (toner image) is formed in the subsequent image forming region 5*c***.

If the magnification of reproduction is low, the exposure scan speed of the light source 4 is high if the rotational speed of the photosensitive drum 5 is constant, and consequently the time for exposure of the density reference plate 35 becomes short. In other words, the exposure finish timing of the density reference plate 35 become earlier, thereby shortening the length l of the patch image **5*b*** in the drum rotating direction.

Accordingly, this causes a problem in that the number of sampling points (a plurality of points in the drum rotating direction to be sampled) for detecting the density of the patch image by the photoelectric sensor 16 becomes smaller. Control over the toner density and the reliability of data of the patch image obtained drops.

This problem can be solved by increasing the length of the density reference plate 35 in the exposure scanning direction, but there is an inevitable limit to the increase in the length of the density reference plate 35 because the available space is extremely limited in order to satisfy the requirement of reducing the size of the reproducing apparatus.

A reproducing apparatus of the type wherein the exposure is started after resting at the home position, in the back start system, has been suggested to overcome this problem. If this system is adopted, however, the number of copy sheets per unit time (CPM) can not be increased.

SUMMARY OF THE INVENTION

It is an object of the present invention to provide an image forming apparatus by which the problem can be solved and a patch image having high reliability can be obtained without increasing the space and without decreasing CPM even when the magnification of reproduction is high.

According to the invention, an image forming apparatus is provided in which a brake sensor is turned on by detecting a holding frame of exposure light source which moves in the backward direction so as to start braking the movement of exposure light source and thereafter to reverse the movement of the exposure light source in the forward direction, a density reference plate and a document are exposed by the exposure light source moving in the forward direction, and a patch image obtained by the exposure of the density reference plate is utilized for controlling the toner density; the stop position of the exposing light source in the backward direction which is determined by the duration of braking time is previously set in accordance with the magnification of reproduction.

Other objects and features of the present invention will become apparent from the following description taken with reference to the accompanying drawings.

DESCRIPTION OF THE PREFERRED EMBODIMENT

An embodiment of the present invention will now be explained.

Figure 4:
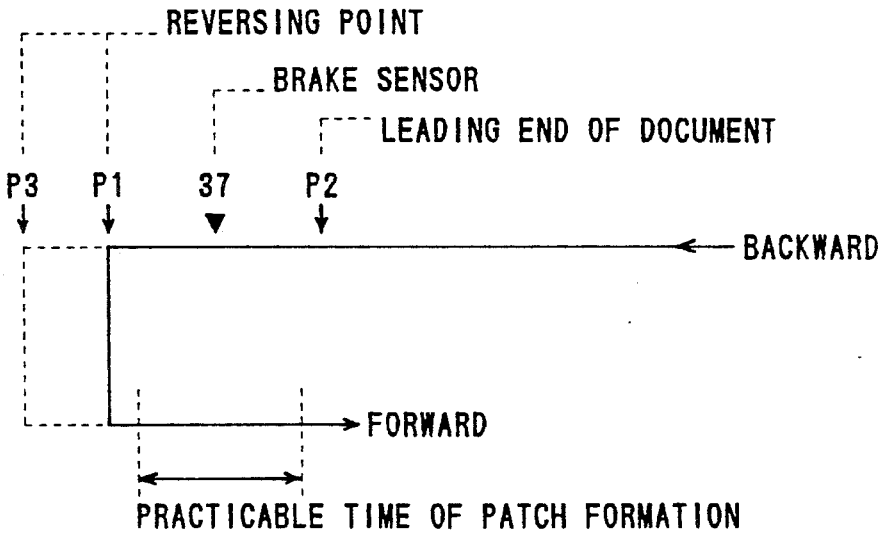
FIG. 4 is a view for explaining the reverse of optical system.
Figure 5:
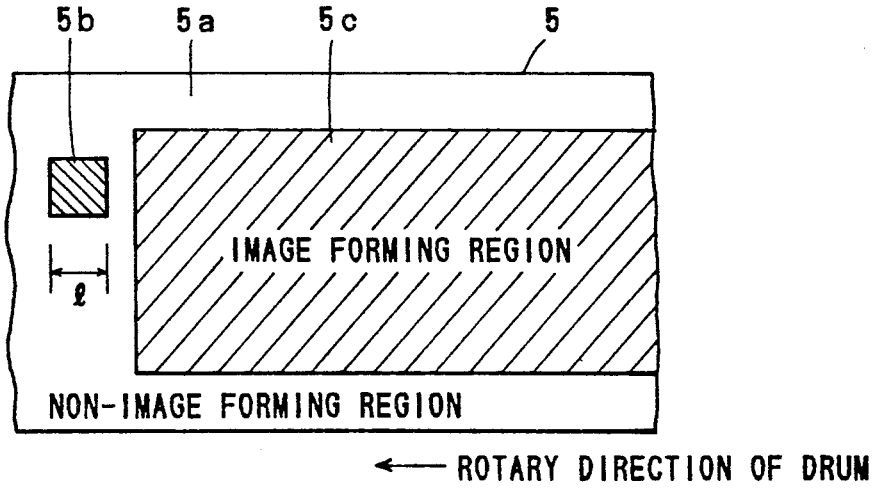
FIG. 5 is a view for explaining a photosensitive surface of a photosensitive drum.

In this embodiment, when the magnification of reproduction is low, the reversing point is moved to a point P3 which is much more distant from the leading end P2 of a document than a conventional point P1, as shown in FIG. 4.

When the reversing point is made more distant, from P1 to P3, the exposure start timing of the photosensitive drum 5 becomes earlier than the timing at the reversing point P1. As a result, the image of the density reference plate 35 can be positioned in the entire portions of the patch image charged portion (the charged portion left by the charge eliminating lamp) on the photosensitive drum 5 and the length l of the patch image in the drum rotation direction can be kept constant independent of the magnification of reproduction.

The positional change of the reversing point from P1 to P3 described above can be accomplished by regulating the quantity of braking which is effected after the holding frame 38 of the light source 4 is detected by the brake sensor 37.

The distance of the reversing point 3 from the leading end P2 of the document must be increased as the magnification of reproduction is set smaller. Accordingly, the duration of braking time after the detection of the light source by the brake sensor 37 must be increased as the magnification of reproduction is set smaller.

Figure 1:
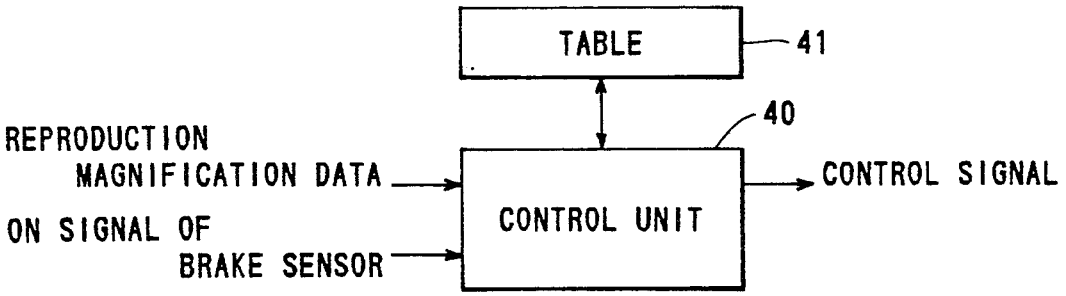
FIG. 1 is a block diagram of a brake control unit in the present invention.
Figure 2:
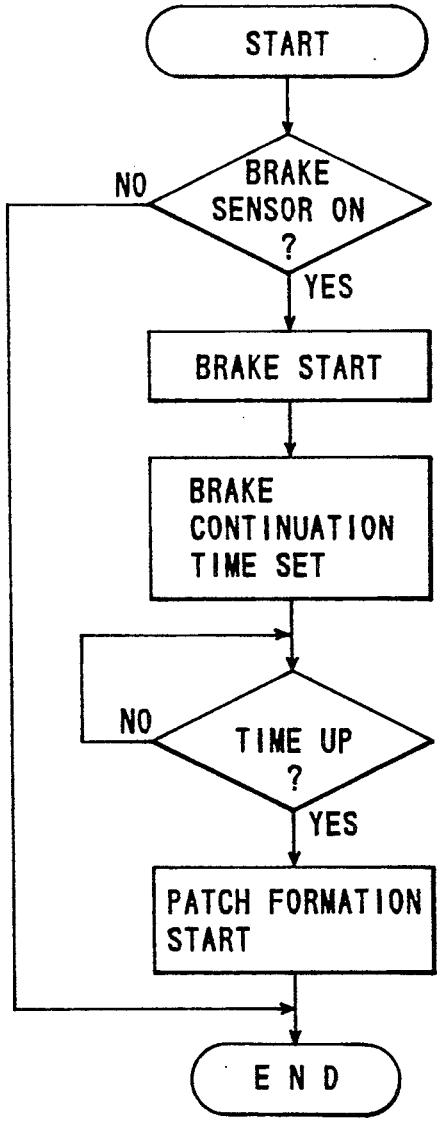
FIG. 2 is a flowchart of the brake control.
Figure 3:
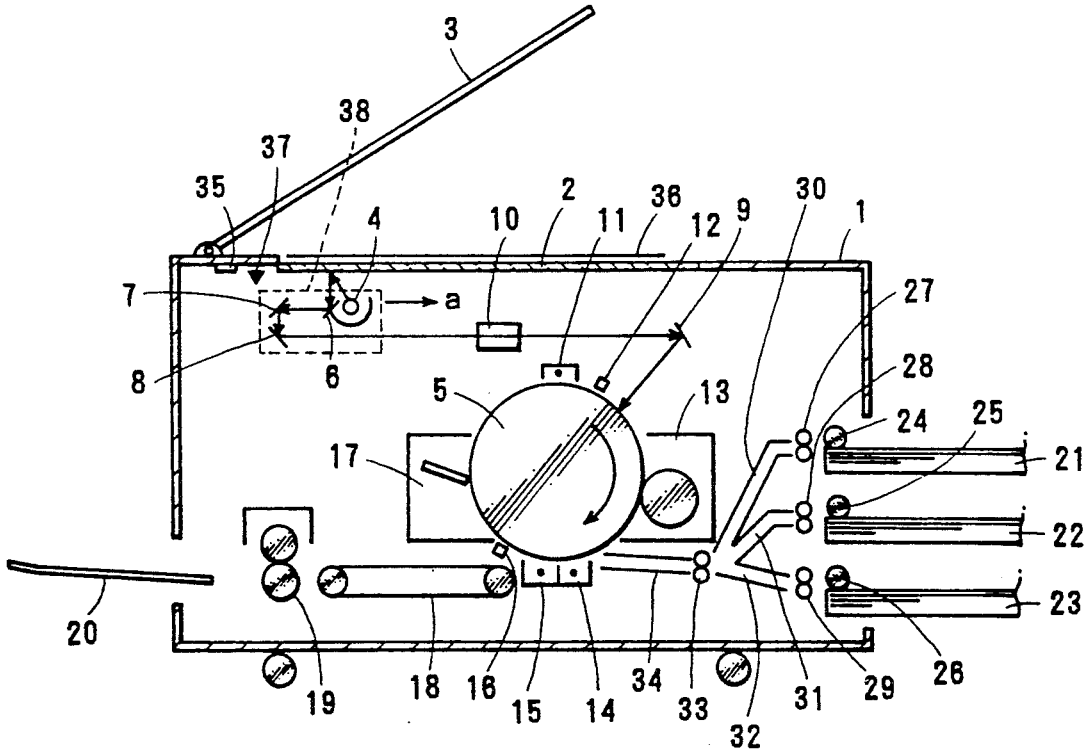
FIG. 3 is a schematic view of a reproducing apparatus.

FIG. 1 is a block diagram of the brake control unit and FIG. 2 is a flowchart of the brake control. Reference numeral 40 denotes a control unit including a CPU, and magnification of reproduction data and ON signal of the brake sensor are inputted to this control unit 40. Reference numeral 41 denotes a data table in which the duration of braking time in accordance with the magnification of reproduction is stored.

When the ON signal of the brake sensor 37 is applied to the control unit 40, the control signal is outputted to start braking. At the same time, the magnification of reproduction data are applied and the data of the duration of braking time is taken out from the table 41 and set. When the set duration of braking time passes by, the movement of the exposure light source 4 in the backward direction is stopped and patch formation is started after reversal.

Setting of the duration of braking time may be made in advance not after the start of braking but before the start of braking by applying the data of the magnification of reproduction when it is set on the operation panel.

EFFECT OF THE INVENTION

In accordance with the present invention described above, a normal patch image can be formed even when the magnification of reproduction is small.

What is claimed is:

1. An image forming apparatus including variable magnification reproduction means, comprising:
   - an exposure light source movable in a forward direction and a backward direction;
   - a brake sensor for detecting when a backward movement of the exposure light source reaches a sensor position;
   - braking means responsive to said brake sensor for braking the backward movement of the exposure light source;
   - reversing means for reversing the movement of the exposure light source to a forward direction;
   - a density reference plate arranged for being exposed by the exposure light source when the exposure light source is moving in the forward direction;
   - patch image forming means for forming a patch image from the exposure of the density reference plate; and
   - control means for setting a stop position of the exposure light source in the backward direction along said density reference plate by varying a duration of braking time of said braking means in accordance with the magnification of reproduction;
   - wherein a patch image of substantially constant length is formed independent of the magnification of reproduction.

2. The image forming apparatus as claimed in claim 1, wherein said control means increases said duration of braking time responsive to a decrease in the magnification of reproduction.

3. The image forming apparatus as claimed in claim 1, wherein said control means sets the stop position of the exposure light source in advance of the start of braking in accordance with the magnification of reproduction.

4. An image forming apparatus including variable magnification reproduction means, comprising:
   - an exposure light source movable in a forward direction and a backward direction;
   - a brake sensor for detecting when a backward movement of the exposure light source reaches a sensor position;
   - braking means responsive to said brake sensor for braking the backward movement of the exposure light source;
   - reversing means for reversing the movement of the exposure light source at a variable reversing position to a forward direction;
   - a density reference plate arranged for being exposed by the exposure light source when the exposure light source is moving in the forward direction;
   - patch image forming means for forming a patch image from the exposure of the density reference plate; and
   - control means for setting the variable reversing position in accordance with the magnification of reproduction;
   - wherein a patch image of substantially constant length is formed independent of the magnification of reproduction.

5. The image forming apparatus as claimed in claim 4, wherein said control means sets the variable reversing position at an increased distance from the sensor position responsive to a decrease in the magnification of reproduction.

6. The image forming apparatus as claimed in claim 4, wherein said control means sets the variable reversing position at an increased distance from an end of the document responsive to a decrease in the magnification of reproduction.

7. The image forming apparatus as claimed in claim 4, wherein said control means sets the variable reversing position in advance of the start of braking in accordance with the magnification of reproduction.

* * * * *